US012221760B2

(12) United States Patent
Huston et al.

(10) Patent No.: US 12,221,760 B2
(45) Date of Patent: Feb. 11, 2025

(54) SYSTEM AND METHOD FOR EXTENDING THE HEIGHT OF A MANHOLE

(71) Applicant: HYDRO-KLEAN, LLC, Des Moines, IA (US)

(72) Inventors: Matt Huston, Rhinelander, WI (US); Chad Hauck, Waukee, IA (US)

(73) Assignee: HYDRO-KLEAN, LLC, Des Moines, IA (US)

( * ) Notice: Subject to any disclaimer, the term of this patent is extended or adjusted under 35 U.S.C. 154(b) by 291 days.

(21) Appl. No.: 17/811,712

(22) Filed: Jul. 11, 2022

(65) Prior Publication Data

US 2024/0011237 A1 Jan. 11, 2024

(51) Int. Cl.
*E02D 29/12* (2006.01)
*E02D 29/14* (2006.01)

(52) U.S. Cl.
CPC ..... *E02D 29/125* (2013.01); *E02D 29/14* (2013.01); *E02D 2200/1685* (2013.01); *E02D 2200/1692* (2013.01); *E02D 2250/0023* (2013.01)

(58) Field of Classification Search
CPC ..... E02D 29/125; E02D 29/128; E02D 29/12; E02D 29/14; E02D 2250/0023; E02D 2200/1685; E02D 2200/1692
See application file for complete search history.

(56) References Cited

U.S. PATENT DOCUMENTS 4,050,839 A * 9/1977 Vollmar ..... E02D 29/1409 52/21
10,947,690 B2 * 3/2021 Huston ..... E02D 15/08
2014/0137508 A1 * 5/2014 Bussio ..... E03F 5/025 52/742.16

* cited by examiner

*Primary Examiner* — Sean D Andrish
(74) *Attorney, Agent, or Firm* — McKee, Voorhees & Sease, PLC

(57) ABSTRACT

A trenchless method of installing a new poured-in-place manhole liner provides structural rehabilitation to an existing buried manhole, and is extended above the existing manhole to a higher pre-determined elevation to match the finished grade of a raised levee design. The new liner can be formed in a single or double stage process, which substantially eliminates trenching and excavation of soil, so that new levee soil is not disturbed. The process is faster and less expensive than building a totally new manhole, and maintains the structural integrity of the levee.

23 Claims, 3 Drawing Sheets

SYSTEM AND METHOD FOR EXTENDING THE HEIGHT OF A MANHOLE

TECHNICAL FIELD

The invention relates to a method of extending a manhole from an initial grade or elevation to an increased grade or elevation when the existing grade is raised. This is a common occurrence in levee construction and maintenance.

BACKGROUND

Earthen levees are common along rivers and other bodies of water for flood control. The levee typically includes buried piping such as parallel drain tiles, storm water and sanitary sewer pipelines that serve these specific utilities. Located along the various pipelines are manhole structures that provide access to the pipelines for inspection and maintenance. The manhole walls are usually made of brick or concrete and are capped with a metal casting and lid residing at the upper grade of the levee. Brick and concrete manholes deteriorate over time, and thus need repair, reinforcement, and/or rehabilitation. At times, it becomes necessary to increase the height of the levee, which then places the existing manhole below the new, raised grade or height of the rebuilt levee. Trenching or excavating for a new manhole is time-consuming and expensive. Therefore, a simpler, less expensive alternative is needed for increasing the height of the existing manhole.

Accordingly, a primary objective of the present invention is the provision of a method for increasing the height of a manhole in the levee without trenching or excavation.

Another objective of the present invention is the provision of a trenchless method of installing a new, poured in place manhole liner to rehabilitate an existing buried manhole and to extend the manhole above an existing grade to a higher pre-determined elevation.

A further objective of the present invention is the provision of a method for modifying a manhole in a levee to meet a raised height of the levee.

Still another objective of the present invention is the provision of a method for rehabilitating and increasing the height of a manhole in the levee while minimizing disturbance of the soil in the levee.

These and other objections become apparent from the following description of the invention.

SUMMARY OF THE INVENTION

A method is provided for modifying a manhole in an earthen levee, when the levee has a beginning grade or height, and is being raised to a new grade height. The existing manhole has a floor, with a barrel extending upwardly from the floor, and capped with a casting having a lid or cover residing at the initial levee grade. Soil is removed from the levee down to the barrel, and then the casting and the cap are removed. A concrete forming system is set up inside the barrel of the manhole and extending upwardly to the new finished grade of the levee. Where the forming systems extends above the existing manhole barrel, an external form is installed, creating an even annular space. Concrete is poured between the forming system and existing manhole and external form to create a new liner or wall adjacent the original inside wall of the manhole barrel, and extending upwardly to the new height. The extended height can be poured in one or two stages. Then a new casting with a cover is installed on top of the extended manhole liner or wall, and then soil is added to the levy to reach the new finished grade.

DETAILED DESCRIPTION

Figure 1:
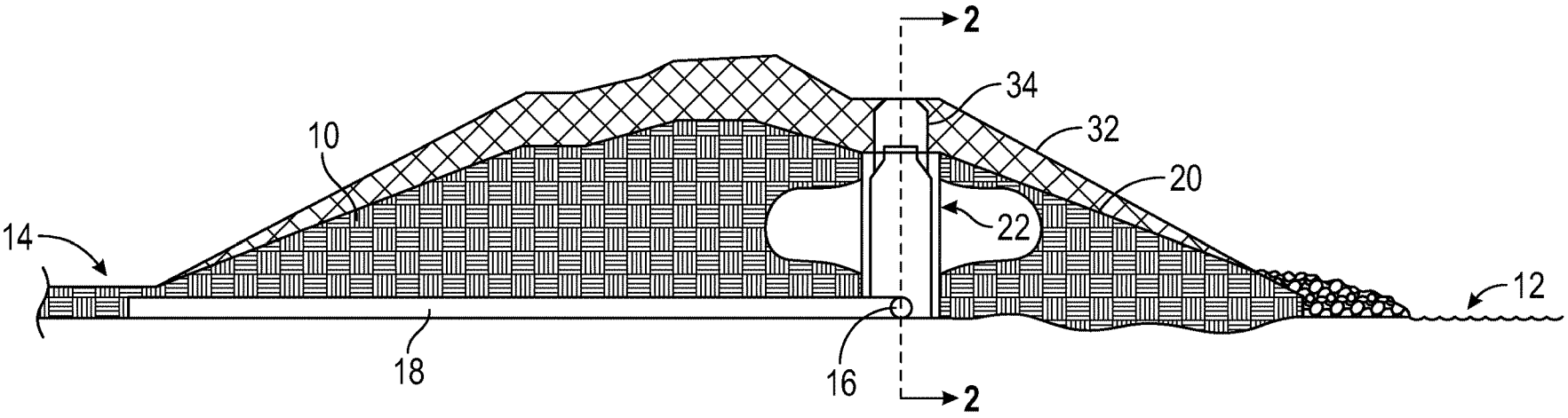
FIG. 1 is an elevation schematic view of a levee with an initial grade, and a raised grade, and having a manhole in accordance with the present invention.

FIG. 1 shows a levee 10 built adjacent a body of water 12 to protect land 14 from flooding. The levee 10 includes at least one pipeline 16 running within the body of the levee. The levee 10 has an upper surface 20 sloped on opposite sides and defining an initial grade or elevation of the levee 10. The levee 10 and the pipeline 16 is conventional, serves various functions such as drain tile, storm water or sanitary sewer conveyance, and may have a variety of constructions.

The levee 10 includes a manhole 32 having a base or floor 24 and a side wall 26 extending upwardly from the floor. The side wall 26 typically has a cylindrical shape. The manhole 20 includes an upper conical section 28, which may be concentric or eccentric, and is topped with a chimney or casting 30 with a removable lid. Preferably, the lid resides at or near the top of the levee 10, as shown in FIG. 1.

Sometimes, the initial grade 20 of the levee 10 must be raised to accommodate changing flood conditions. In such situations, the existing manhole 22 will be below the new raised grade 32. Rather than excavating and installing a new manhole prior to creation of the new grade 32, or excavating and installing a new manhole after the new grade 22 is created, the present invention provides a method of increasing the height of the manhole 22 from the initial grade 20 to the finished, raised grade 32, without excavation or trenching of the existing manhole prior additional soil added to the levee.

Figure 3:
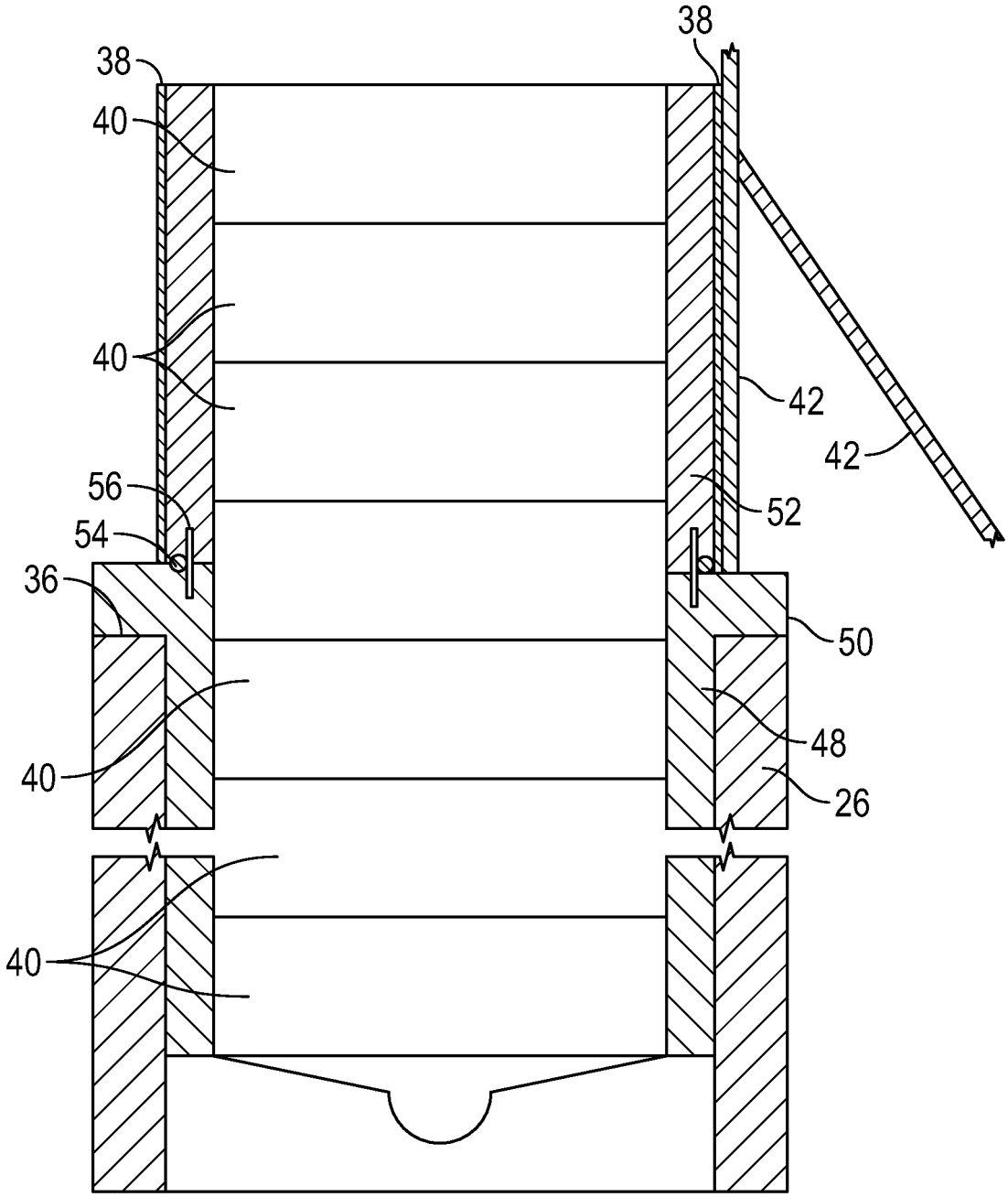
FIG. 3 is a partial sectional view showing a two stage alternative method for increasing the height of the existing manhole from the initial levee grade to the finished, raised levee grade.

The process utilizes the Hydro-Klean Monoform system, which creates a new monolithic concrete wall 34 adjacent the interior of the manhole side wall 26. With the Monoform system, custom forms, such as that disclosed in Applicant's co-pending patent application U.S. Ser. No. 17/248,635, FIG. 3, are erected inside the manhole 22 to create an annular space to be filled with a high-strength ready-mix concrete adjacent the manhole side wall 26. The forms of the Monoform system have various diameters to fit different existing manholes, including those having concentric and eccentric cone configurations. The finished, rehabilitated manhole has a similar design and life expectancy to that of installing a new, precast manhole, but without excavation.

In the process of the invention, the first step is to determine the existing profile, diameter, and depth of the existing manhole 22, as well as the point wherein the sidewall or barrel 26 intersects and transitions into the cone reducer section 28. Soil may be removed to expose the conical section 28. Then, the casting 30 and conical section 28 are removed, so as to expose an upper edge 36 of the barrel sidewall 26. If needed, a new floor can be provided on the floor 24 to rebuild and/or repair the existing manhole, while maintaining or providing smooth flow lines for the pipe 18.

Figure 2:
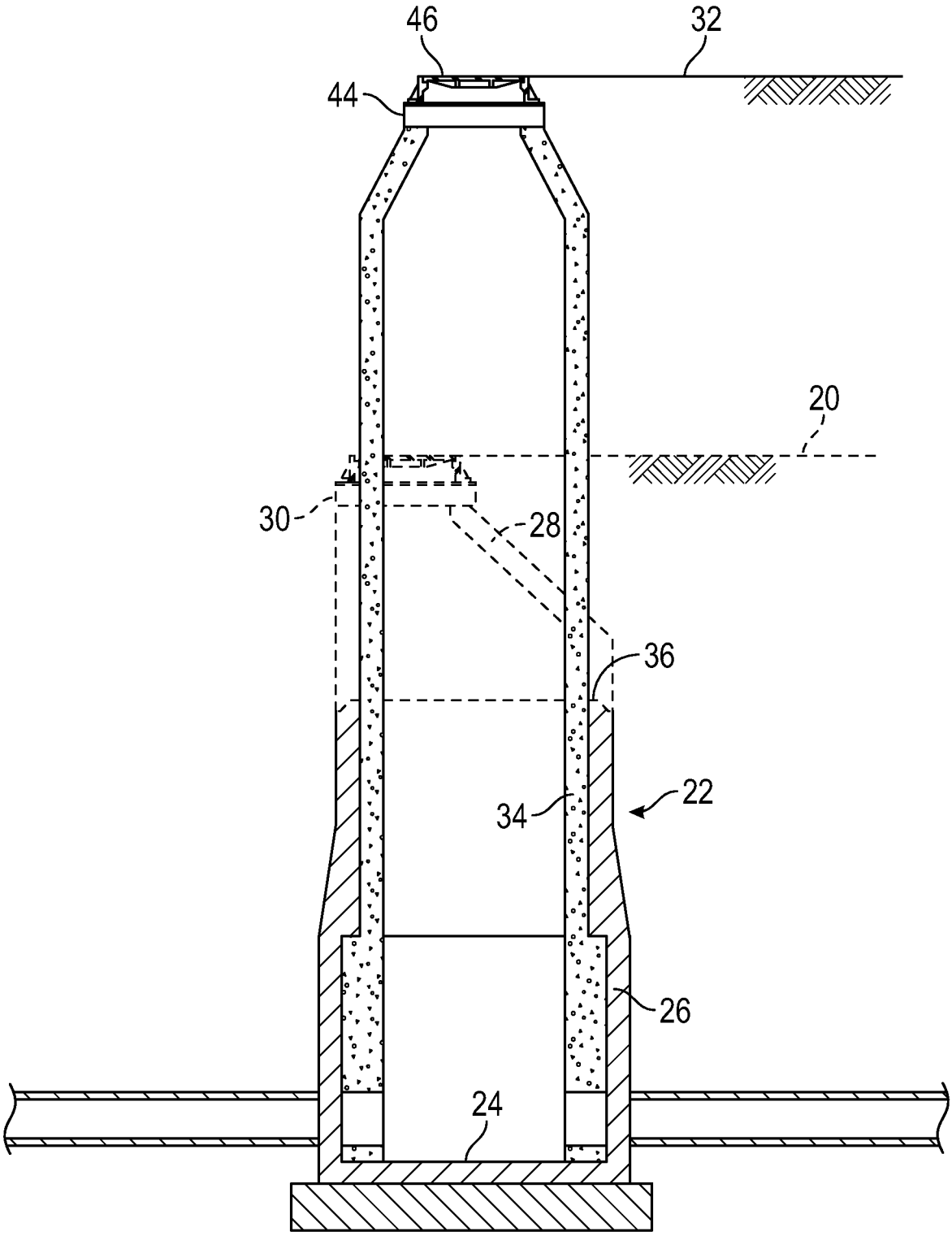
FIG. 2 is a sectional view showing a single stage method of increasing the height of the manhole from the initial grade to the raised, finished grade of the levee.

Then, the Monoform system can be assembled within the manhole 22, to achieve an annular space with a predetermined thickness for the new wall 34, as determined by soil density load calculations. The inlet piping and outlet piping will be blocked out or slipped with PVC inserts butted to the base form, while extending slightly into the host pipe connections to maintain the full diameter of the pipes 18 through the new liner wall 34 annulus. The forming system preferably is erected to an elevation extending at least 6 inches above the edge 36 of the manhole sidewall 26. An exterior concrete pour tube 38 is positioned around the forms 40 of the model form system on the top edge 36 of the manhole 22. The tube 38 may be braced, for example with a 2×4 lumber 42, if desired. Then, ready mix concrete can be poured into the annulus between the sidewall 26 and the forms 40 and between the tube 38 and the forms 40, and allowed to harden so as to create the new sidewall 34 to the desired height. Preferably, the ready mix concrete is a high strength, fiber-reinforced composition. After the concrete has cured, the forms 40 are disassembled and removed. Then, a new casting 44 with a lid 46 can be installed on top of the new wall 34, as shown in FIG. 2.

In an alternative methodology, the new extended sidewall can be formed in two stages, as shown in FIG. 3. The first stage creates a lower concrete liner 48, using the Monoform system forms 40, described above for the single stage pour process. The lower liner 48 terminates an upper lip 50 which overlies the upper edge 36 of the manhole side wall 26. After the lower liner 48 has cured, but before the forms 40 are removed, additional forms are erected to the desired height, and the exterior pour tube 38 is set upon the lip 50 of the lower liner 48. Then, additional ready mix concrete is poured to form the upper liner 52, as seen in FIG. 3. If desired, a sealing gasket 54 can be positioned between the lip 50 and the upper liner 52 to prevent moisture migration. Also, if desired, connecting rods 56 can be used to structurally connect the upper liner 52 to the lower liner 48. Then, the new casting 44 and new lid 46 can be installed on the new wall 34 at the elevation of the new finishing grade 32. Then, soil can be backfilled around the new wall 34 to complete the height increase for the levee 10.

The new casting 44 preferably is set upon a sealing gasket (not shown) on the top of the new sidewall 34 and secured with stainless steel anchor bolts (not shown). The new cover 46 is preferably a bolt-down style, and secured with stainless steel bolts.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

The invention claimed is:

1. A method of modifying an existing manhole, wherein a beginning grade is being raised to a new finished grade, and the manhole having a floor, a barrel extending upwardly from the floor to a height below the beginning grade, and a cone on top of the barrel with a cover at the beginning grade, the method comprising:

removing the cover and the cone;

erecting lower forms inside the barrel to form a gap between the lower forms and the barrel;

erecting upper forms above the barrel;

pouring a new concrete in the gap to create a lower liner inside the barrel;

pouring a new concrete in the upper forms to create an upper liner on top of the lower liner to a height above the beginning grade;

removing the lower and upper forms after the lower and upper liners have cured;

installing a new cone and a cover on top of the upper liner at a height to match the finishing grade; and then adding soil to reach the finishing grade.

2. The method of claim 1 further comprising removing soil from the beginning grade, down to the barrel, before removing the cover and cone.

3. The method of claim 1 further comprising pouring a new floor inside the barrel.

4. The method of claim 3 wherein the lower liner is poured on top of the new floor.

5. The method of claim 1 wherein the lower liner engages an inside wall of the barrel along a full height of the barrel.

6. The method of claim 1 wherein the lower liner is formed with pipe inlets and outlets.

7. The method of claim 1 wherein the lower liner extends above the barrel.

8. The method of claim 1 wherein the lower and upper liners have matching inside diameters.

9. The method of claim 1 wherein the lower liner has an upper lip overlying an upper edge of the barrel.

10. The method of claim 9 wherein the upper liner is poured on top of the lip of the lower liner.

11. A trenchless method of installing a new poured-in-place manhole liner to rehabilitate an existing buried manhole and to extend above an existing grade to a higher pre-determined elevation, the method comprising:

removing soil around a top portion of the existing manhole;

installing lower forms inside the existing manhole for a new lower liner;

installing upper forms above the existing manhole for an upper extension above the existing manhole;

pouring concrete into the lower and upper forms to create the lower liner and the upper extension;

removing the upper and lower forms after the concrete has at least partially cured;

installing a new casting on top of the upper extension; and adding soil around the upper extension to the pre-determined elevation.

12. The method of claim 11 wherein the soil is part of a levee.

13. The method of claim 11 wherein the lower liner and the upper extension have inner surfaces with the same diameters.

14. The method of claim 11 further comprising pouring a new floor inside the manhole before the lower liner is poured.

15. The method of claim 11 further comprising pouring the lower liner before pouring the upper extension.

16. The method of claim 15 wherein the lower liner cures before the upper extension is poured.

17. The method of claim 11 wherein the inner lower liner and the upper extension are poured in a single step.

18. The method of claim 11 wherein the concrete cures before adding the soil to the pre-determined elevation.

19. The method of claim 11 wherein the lower liner matingly engages an interior surface of the existing manhole.

20. The method of claim 11 wherein the inner liner extends above the removed soil.

21. The method of claim 1 wherein the lower and upper liners are poured in a single step.

22. The method of claim 1 wherein the lower liner is poured first and allowed to cure, and then the upper liner is poured and allowed to cure.

23. The method of claim 11 wherein the inner liner is formed with an upper lip overlying an upper edge of the manhole, and the upper extension is poured on top of the lip.

* * * * *